US010995970B2

(12) United States Patent
Gross

(10) Patent No.: US 10,995,970 B2
(45) Date of Patent: May 4, 2021

(54) MODULAR HEATING SYSTEM

(71) Applicant: ORTAL—HEATING & AIR CONDITIONING SYSTEMS LTD., Hod Hasharon (IL)

(72) Inventor: Benjamin-Tal Gross, Hod Hasharon (IL)

(73) Assignee: ORTAL—HEATING & AIR CONDITIONING SYSTEMS LTD., Hod Hasharon (IL)

( * ) Notice: Subject to any disclaimer, the term of this patent is extended or adjusted under 35 U.S.C. 154(b) by 150 days.

(21) Appl. No.: 16/268,647

(22) Filed: Feb. 6, 2019

(65) Prior Publication Data

US 2019/0242619 A1 Aug. 8, 2019

Related U.S. Application Data

(60) Provisional application No. 62/626,938, filed on Feb. 6, 2018.

(51) Int. Cl.

| | |
|---|---|
| ***F24H 3/00*** | (2006.01) |
| ***F24H 9/00*** | (2006.01) |
| ***F24H 9/18*** | (2006.01) |
| ***F24H 9/02*** | (2006.01) |
| ***F24H 9/06*** | (2006.01) |

(52) U.S. Cl.

CPC ..... *F24H 3/006* (2013.01); *F24H 9/0063* (2013.01); *F24H 9/0068* (2013.01); *F24H 9/02* (2013.01); *F24H 9/06* (2013.01); *F24H 9/1881* (2013.01)

(58) Field of Classification Search

CPC ..... F24H 3/006

USPC ..... 126/116 R

See application file for complete search history.

(56) References Cited

U.S. PATENT DOCUMENTS 4,485,797 A * 12/1984 D'Alessandro ..... F24B 7/002 126/1 A 2014/0083309 A1* 3/2014 Reese ..... B23P 19/04 99/474

2015/0253037 A1 9/2015 Rumens et al.

FOREIGN PATENT DOCUMENTS

WO 2015134803 A2 9/2015

OTHER PUBLICATIONS

Davinci Custom Fireplaces, "Category I, II, III, & IV Fireplaces—3Ft to 21 Ft", Mar. 2017, 24 pages.

Davinci Custome Fireplaces, "Category 2 & 3 Owner's Manual", 2016, 98 pages.

* cited by examiner

*Primary Examiner* — Avinash A Savani

(74) *Attorney, Agent, or Firm* — Dorsey & Whitney LLP

(57) ABSTRACT

A kit for assembling a heating system and a heating system, which when assembled, comprises at least two heating devices, a partition constituting at least a part of one wall of each of the devices, which separates between interiors thereof, and a sealing arrangement mounted at least along upper, lower and rear edges of the partition to at least reduce a heat transfer between the interiors of the two devices at said edges so as to allow individual heating operation of each of the heating devices; the heating devices having a common front wall at least seen from an exterior of the system as a single front face of the system.

9 Claims, 5 Drawing Sheets

MODULAR HEATING SYSTEM

TECHNOLOGICAL FIELD

The present invention relates to a heating system comprised by a plurality of heating units.

BACKGROUND

Modular heating systems are known in the art. Example of such modular system is disclosed in U.S. Patent Application Publication No. 2015/0253037.

GENERAL DESCRIPTION

According to one aspect of the presently disclosed subject matter, there is provided a heating system, which when assembled, comprises at least two heating devices, each having side, front and rear walls extending between upper and lower walls of the device all defining therebetween an interior of the heating device, and each comprising an air inlet configured to allow air flow into said interior and an exhaust outlet in gas communication with said interior to carry exhaust away therefrom during operation of the device.

The above system can have a partition constituting at least a part of one wall of each of the devices, which separates between the interiors thereof, the partition having upper, lower, rear and front edges, which are disposed adjacent the respective upper, lower, rear and front walls of the two devices.

The above system can further have a sealing arrangement mounted at least along the upper, lower and rear edges of the partition to at least reduce a heat transfer between the interiors of the two devices at said edges so as to allow individual heating operation of each of the heating devices.

The above system can further have connection elements, by virtue of which said two heating devices are fixedly attached to each other so as to have a common front wall constituted by the front walls of the two devices, the common front wall being seen from an exterior of the system as a single front face of the system.

Each of the heating devices can have a longitudinal axis extending within the interior of the heating device along the front, rear, upper and lower walls thereof so as to cross the side walls of the device.

The heating devices can be so attached to each other that their longitudinal axes are aligned, the partition being oriented perpendicularly to these axes and constituting a common side wall of the devices.

The heating devices can be so attached to each other that their longitudinal axes form an angle with each other, the partition being oriented so as to form corresponding angles with the longitudinal axes of the devices, and constituting a side wall of a first one of the two devices and an extension of the front wall of a second one of the devices.

The partition can be perpendicular to the longitudinal axis of the first device and parallel to the longitudinal axis of the second device.

According to another aspect of the presently disclosed subject matter, there is provided a kit for assembling the above heating system.

The kit can comprise at least two units each configured to be assembled in the system so as to independently function as one of the heating devices having its own interior, each unit having an air inlet configured to allow air flow into the interior and an exhaust outlet in gas communication with said interior to carry exhaust away therefrom, in operation of the device, the units each being free of a front wall and a wall which can be used for separating between the interiors of the devices, these walls being other than upper, lower and rear walls of the units; complementary walls configured to be mounted to the units during assembly of the system to convert them into the heating devices each having its own interior, the complementary walls including at least a partition configured to be mounted between the units so as to separate between the interiors of the two devices; the partition having an upper, lower, rear and front edge and having such shape and dimension as to allow these edges to be disposed adjacent the respective upper, lower, rear and front walls of the two units.

The kit can further include a sealing arrangement mounted, or configured to be mounted, along the upper, lower and rear edges of the partition to at least reduce heat transfer between the interiors of the two devices at said edges, when the two units are fixedly attached to each other, so as to allow each of the devices to operate individually within said system.

The complementary walls can further include at least one wall configured to provide each of the two devices with its front wall and to constitute a common front wall of the system seen from an exterior of the system as a single front face thereof;

The kit can further include connecting elements configured to fixedly attach said units to each other at their upper, lower and rear walls; and Each unit has a longitudinal axis extending along the rear, upper and lower walls thereof.

The units can be configured to be so attached to each other that their longitudinal axes are aligned, the partition being configured for mounting between the two units perpendicularly to these axes and so as to constitute a common side wall of the devices.

The units can be configured to be so attached to each other that their longitudinal axes form an angle with each other, the partition being configured for mounting in such orientation as to form corresponding angles with the longitudinal axes of the devices, and as so as to constitute a side wall of a first one of the two devices and an extension of the front wall of a second one of the devices.

The partition can be configured for mounting so as to be perpendicular to the longitudinal axis of the first unit and be parallel to the longitudinal axis of the second unit.

BRIEF DESCRIPTION OF THE DRAWINGS

In order to better understand the subject matter that is disclosed herein and to exemplify how it may be carried out in practice, embodiments will now be described, by way of non-limiting example only, with reference to the accompanying drawings, in which.

DETAILED DESCRIPTION OF EMBODIMENTS

Figure 1A:
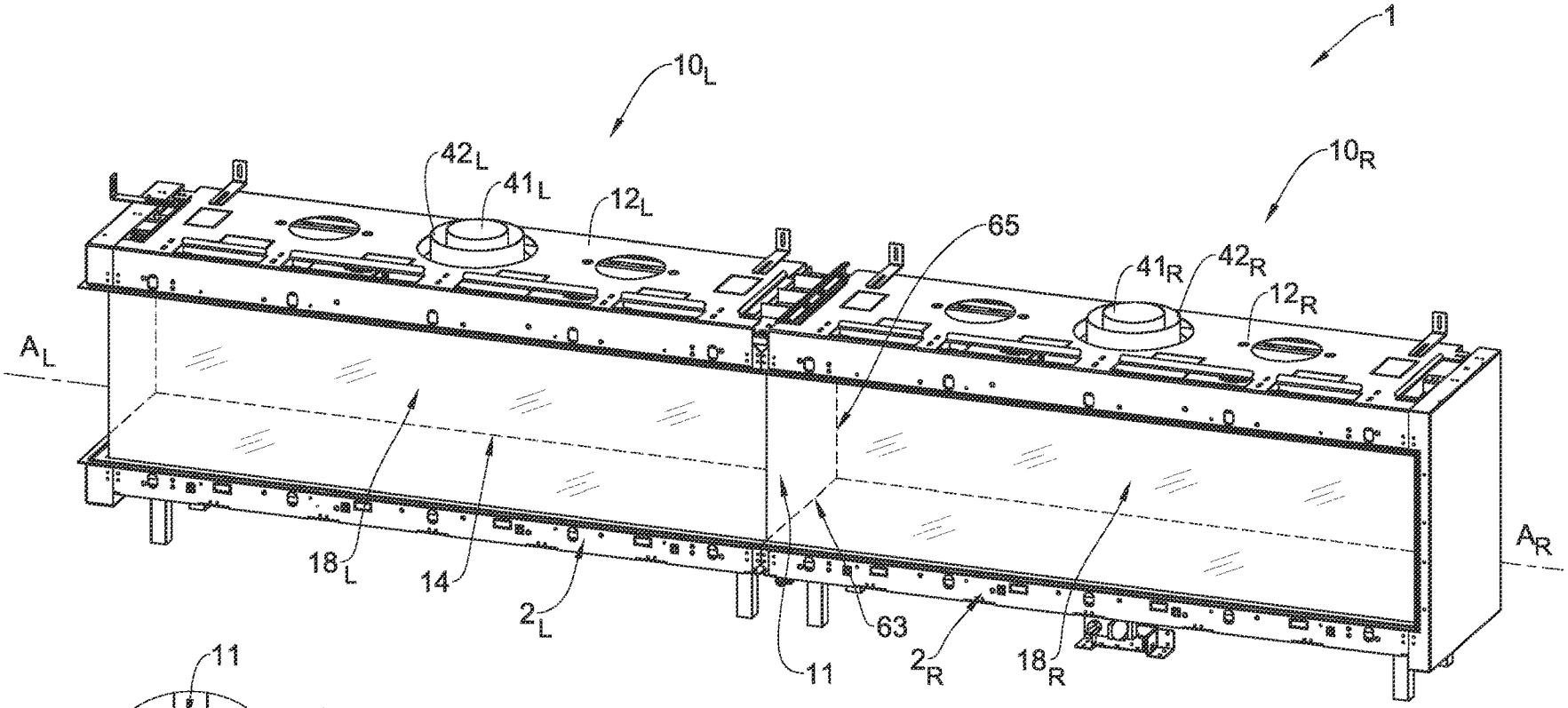
FIG. 1A is a perspective view of an example of a linear heating system, according to one embodiment of the presently disclosed subject matter.

FIG. 1A demonstrates one example of a linear heating system generally designated as 1, according to one embodiment of the presently disclosed subject matter. The heating system 1 comprises heating devices 10 having their longitudinal axes aligned along a single longitudinal axis of the system 1. In the described example, the number of the heating devices is two, and they will further be referred to either as 'the heating devices 10' or as 'right heating device $\mathbf{10}_R$' and 'left device $\mathbf{10}_L$'. However, a system according to the presently disclosed subject matter can have three or more such devices, at least two of which can be as described herein with reference to the heating devices 10.

Figure 2A:
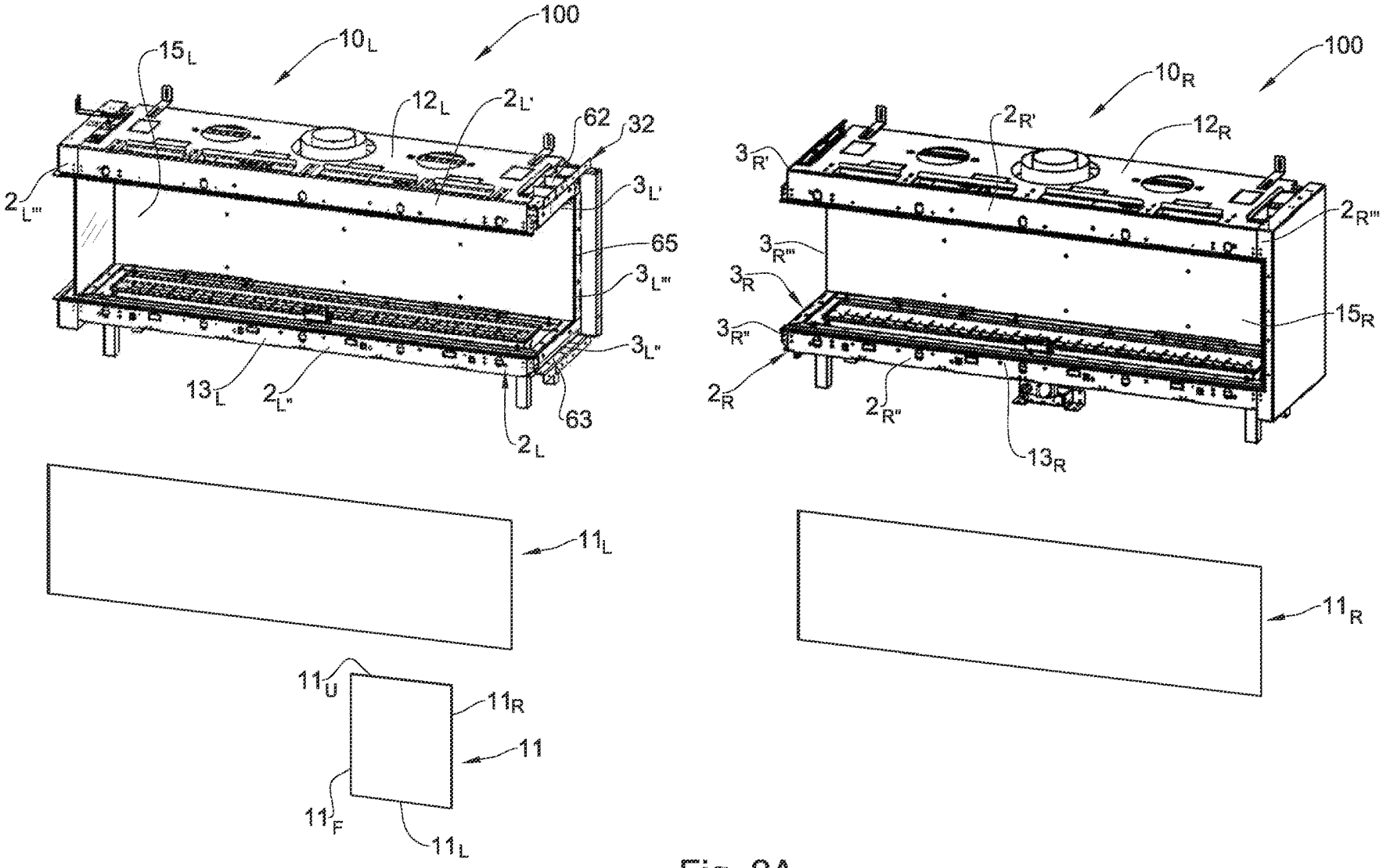
FIG. 2A is an exploded view of a heating system shown in FIG. 1A, without its connection and sealing elements.

As best seen in FIG. 2A, the heating devices $\mathbf{10}_R$ and $\mathbf{10}_L$ have respective front flanges $\mathbf{2}_R$ and $\mathbf{2}_L$, and attachment flanges $\mathbf{3}_R$ and $\mathbf{3}_L$, at which the heating devices are fixedly and sealingly attached to each other, so that their front flanges are aligned to constitute a single front flange 2 of the system 1 as seen in FIG. 1A.

The front flanges $\mathbf{2}_R$ and $\mathbf{2}_L$ of the heating devices 10 are each defined by a respective front flange top edge $\mathbf{2}_R'$, $\mathbf{2}_L'$, front flange bottom edge $\mathbf{2}_R''$, $\mathbf{2}_L''$, and front flange side edge $\mathbf{2}_R'''$, $\mathbf{2}_L'''$ extending therebetween and spaced from the attachment flange $\mathbf{3}_R$, $\mathbf{3}_L$ of the heating device.

The attachment flanges $\mathbf{3}_R$ and $\mathbf{3}_L$ of the heating devices 10 are each defined by a respective attachment flange top edge $\mathbf{3}_R'$, $\mathbf{3}_L'$, attachment flange bottom edge $\mathbf{3}_R''$, $\mathbf{3}_L''$, and attachment flange rear edge $\mathbf{3}_R'''$, $\mathbf{3}_L'''$ extending therebetween.

More particularly, as seen in FIG. 2A, the heating devices $\mathbf{10}_R$ and $\mathbf{10}_L$ comprise, respectively:

top walls $\mathbf{12}_R$ and $\mathbf{12}_L$ whose front edges constitute the front flange top edges $\mathbf{2}_R'$ and $\mathbf{2}_L'$ and whose associated side edges constitute the attachment flange top edges $\mathbf{3}_R'$ and $\mathbf{3}_L'$, bottom walls 13R and 13L whose front edges constitute the front flange bottom edges $\mathbf{2}_R''$ and $\mathbf{2}_L''$ and whose associated side edges constitute the attachment flange bottom edges $\mathbf{3}_R''$ and $\mathbf{3}_L''$, rear walls 15R and 15L, whose associated side edges constitute the attachment flange rear edges $\mathbf{3}_R'''$ and $\mathbf{3}_L'''$; and side walls $\mathbf{11}_R$ and $\mathbf{11}_L$, whose front edges spaced from the attachment flanges 3R and 3L constitute the front flange side edges $\mathbf{2}_R'''$ and $\mathbf{2}_L'''$.

The system 1 can further comprises top, bottom and rear connection and sealing elements (not shown in FIG. 2A) used to provide a fixed and sealed connection between the respective top, bottom and rear walls of the heating devices 10 at their respective attachment flanges, forming a top attachment area 62 between the attachment flange top edges $\mathbf{3}_R'$ and $\mathbf{3}_L'$, a bottom attachment area 63 between the attachment flange bottom edges $\mathbf{3}_R''$ and $\mathbf{3}_L''$, and a rear attachment area 65 between the attachment flange rear edges $\mathbf{3}_R'''$ and $\mathbf{3}_L'''$. The connection elements associated with the above attachment areas can be constituted by any suitable connection means and, for example, can include connection plates or the like mounted to the walls of the heating devices at their interior or exterior so as to cover the attachment areas thereof, by means of fastening elements such as bolts, screws, rivet and/or by welding. Further, the sealing elements associated with the above attachment areas can be constituted by any suitable sealing means such as e.g. adhesive gaskets.

The system 1 further comprises a transparent partition 11 having a partition upper edge $\mathbf{11}_U$ sealingly received within or connected to the top attachment area 62, a partition lower edge $\mathbf{11}_L$ sealingly received within or connected to the bottom 63 attachment area, a partition rear edge $\mathbf{11}_R$ sealingly received within or connected to the rear attachment area 65, and a partition front edge $\mathbf{11}_F$.

Figure 1B:
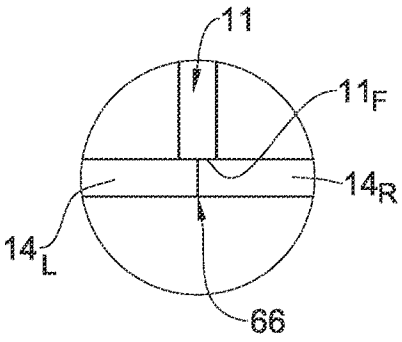
FIG. 1B is a schematic enlarged illustration of a seam area of the system shown in FIG. 1A, in its top view.

The system 1 further comprises transparent front walls $\mathbf{14}_R$ and $\mathbf{14}_L$ connected to the front flanges $\mathbf{2}_R$ and $\mathbf{2}_L$ of the heating devices 10 and glued to each other at a seam area 66 by a transparent glue to form a single transparent front wall 14 of the system 1. As seen in FIG. 1B, the front edge of the partition $\mathbf{11}_F$ is in contact with the front walls $\mathbf{14}_R$ and $\mathbf{14}_L$ at the seam area 66. The partition 11 can be glued to the seam area 66. The transparent front wall 14 of the system 1 can be seamless, i.e. can be constituted by a unitary transparent plate having a length sufficient to cover the entire front flange of the system. In this case the unitary front wall 14 can be considered as having two, right and left, front wall portions covering the respective right and left front flanges of the heating devices, similarly to the front walls $\mathbf{14}_R$ and $\mathbf{14}_L$.

As shown in FIG. 1A, the heating devices $\mathbf{10}_R$ and $\mathbf{10}_L$ each has its own interior $\mathbf{18}_R$, $\mathbf{18}_L$ bounded by the front, top, bottom, rear and side walls of the respective device $\mathbf{10}_R$, $\mathbf{10}_L$ as well as the partition 11.

The front wall 14, whether seamless or constituted by the front walls $\mathbf{14}_R$ and $\mathbf{14}_L$ as described above, and the partition 11, can be made of glass or transparent thermo-resistant plastic, so that the partition can be invisible from an exterior of the system though the front walls, and the two interiors $\mathbf{18}_R$ and $\mathbf{18}_L$ can be seen as a single continuous interior 18 of the system. The glue, by which the two front walls $\mathbf{14}_R$ and $\mathbf{14}_L$, and optionally also the partition 11, can be connected to each other along their associated edges can be any transparent glue such as a silicone glue.

With reference to FIG. 1A, each heating device $\mathbf{10}_R$, $\mathbf{10}_L$ further comprises an air inlet $\mathbf{41}_R$, $\mathbf{41}_L$, configured to allow air flow from the exterior of the heating device, into its interior $\mathbf{18}_R$, $\mathbf{18}_L$, and an exhaust outlet $\mathbf{42}_R$, $\mathbf{42}_L$, configured to carry exhaust from the interior $\mathbf{18}_R$, $\mathbf{18}_L$ of the heating device to its exterior during operation of the device. In the example represented in FIGS. 1A and 2A, the air inlet $\mathbf{41}_R$, $\mathbf{41}_L$ and the exhaust outlet $\mathbf{42}_R$, $\mathbf{42}_L$ are in the form of concentric pipes extending between the interior $\mathbf{18}_R$, $\mathbf{18}_L$ of the respective heating device and its top wall $\mathbf{12}_R$, $\mathbf{12}_L$, so that the air inlet pipe has a smaller diameter than, and is surrounded by, the exhaust outlet pipe. The air inlet and the exhaust outlet can be of any in other standard embodiments not shown in the figures.

With the above arrangement, each of the heating devices $\mathbf{10}_R$ and $\mathbf{10}_L$ can be individually operated and controlled, and can thus include a separate gas line, burner assembly and control unit (not shown).

Due to the use of the sealing elements at the attachment areas 62, 63, 65, the heat loss thereat from the interiors of the two devices during operation of the heating system 1 is avoided or at least reduced, allowing each of the heating devices $\mathbf{10}_R$ and $\mathbf{10}_L$ to maintain their planned heat regime, and the operation of one heating device does not affect the heat regime of the other heating device. In a specific example in which the heating devices are operated by a remote control, a single remote controller can control both heating devices.

Prior to being assembled to become the heating device 10 in the system 1 as shown in FIG. 1A, each such device could be in the form of a unit 100 (FIG. 2A), produced without the front wall 14 and the partition wall 11, but with all other features of the heating device described above. The use of such pre-produced unit can be advantageous when it is desired to allow using such units not only for assembling them in a system like the system 1 as described below, but also for assembling therefrom an autonomous heating device with its own front wall other than the front walls $\mathbf{14}_R$ and $\mathbf{14}_L$, and its own side wall other than the partition wall 11, all missing from FIG. 2A. Moreover, it is more than likely that the main purpose for which such units are to be originally produced is assembling therefrom such autonomous heating devices rather than systems of the kind to which the presently disclosed subject matter refers. However, the fact that each of the units can also be used, as is, for producing heating systems of the kind to which the presently disclosed subject matter refers, constitutes one of essential advantages of the latter systems. The units will further be referred to either as 'the units 100' or as 'a right unit $\mathbf{100}_R$' and a 'left unit $\mathbf{100}_L$', Thus, to produce the heating system 1 shown in FIG. 1A from the units $\mathbf{100}_R$ and $\mathbf{100}_L$ a kit can be used comprising:

the connecting and sealing elements;

the partition 11; and the front walls 14.

One example of connecting and sealing elements, which can be used in the system 1 to connect to each other the units 100 described above will now be described in detail with reference to FIG. 2B. To facilitate the description, each attachment area 62, 63 and 65 mentioned above will be considered as having an outer portion facing towards the exterior of the system 1, and an opposite inner portion facing the partition 11.

Figure 2B:
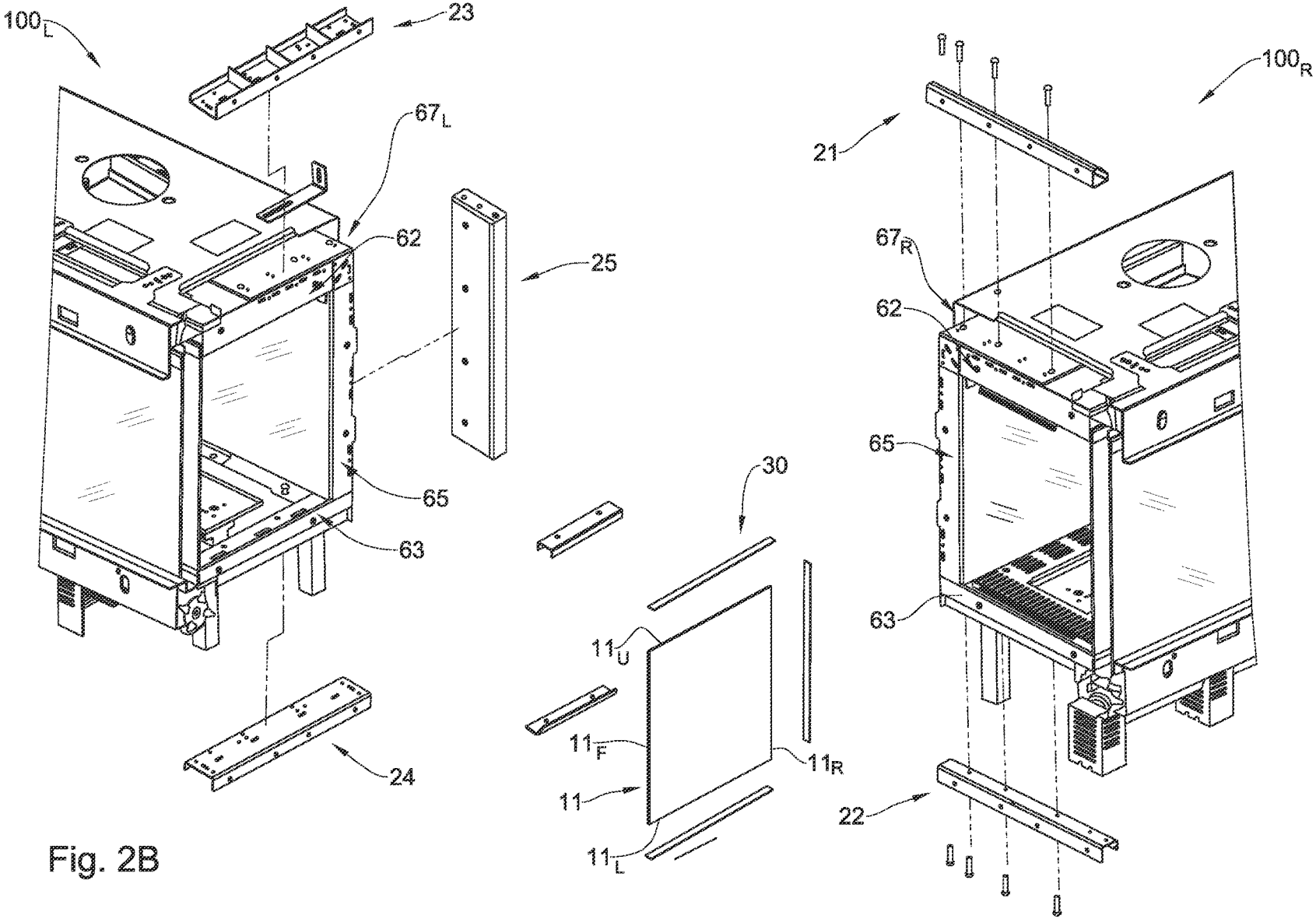
FIG. 2B an enlarged part of the exploded view shown in FIG. 2A, in which only portions of heating devices thereof are seen that are close to their attachment flanges, and which also includes examples of connection and sealing elements that can be used for attaching the heating devices to each other.

In the specific example shown in FIG. 2B, the connecting elements include a right top connecting member 21, a right bottom connecting member 22, a left top connecting member 23, a left bottom connecting member 24, and a rear connecting member 25, the arrangement being such that, when in use, the right and left top connecting members 21 and 23 fulfil a function of connecting the two units at their top walls, and the right and left bottom connecting members 22 and 24, fulfil the function of connecting the two units at the bottom. The connecting members can have a length corresponding to that of the respective attachment flange top edges $\mathbf{3}_R$' and $\mathbf{3}_L$', and the attachment flange bottom edges $\mathbf{3}_R$" and $\mathbf{3}_L$".

More particularly, the members 21 and 23 are configured to be fixed with their first portions to the corresponding top walls of the units 100 on two sides of the outer portion of the top attachment area 62 and with their second portions to each other by any suitable mechanical means such as bolts and nuts, screws, rivet and/or by welding, and the members 22 and 24 are fixed with their first portions to the corresponding outer portion of the bottom attachment area 63 and with their second portions to each other by any suitable mechanical means, such as bolts and nuts, screws, rivet and/or by welding. In the described example, the right and left top and bottom connecting members have an elongated L-shaped profile defined by two ribs, of which one rib constitutes the above first portion and the other—the above second portion.

In general, the top and bottom connecting members may be different from or identical to each other. In the present example, there is a pair of two identical connecting members for each of the heating devices $\mathbf{10}_R$ and $\mathbf{10}_L$.

In the example shown in FIG. 2B, the connecting elements can further include a right and a left recess $\mathbf{67}_R$ and $\mathbf{67}_L$ in the respective rear walls of the units 100 adjacent to and coextensive with the rear edges $\mathbf{3}_R$'''' and $\mathbf{3}_L$'''', so that when the attachment flanges of the two units 100 are attached to each other, a common recess 67 is formed including the outer portion of the rear attachment area 65, and a rear connection plate 25 configured for being mounted in the common recess 67 so as to cover the outer portion of the rear attachment area 65, by any suitable mechanical means, such as bolts, screws, rivet and/or by welding. In the present example, the top connecting members 21 and 23 can further be fixed to the rear connection plate 25 at its top. All the connecting members can be made of a stiff material such as aluminum.

In the example shown in FIG. 2B, the sealing elements include a plurality of gaskets 30 configured for being mounted to the top, bottom and rear attachment areas 62, 63, 65 at their outer and inner portions. Gaskets configured for being mounted at the outer portions of the attachment areas can be in the form separate pieces or rather they can constitute portions of an elongated unitary outer gasket configured to extend along the three attachment areas at their outer portions. The same is correct regarding the gaskets configured for being mounted at the inner portions of the attachment areas, with a difference that these inner gaskets are configured to be mounted so as to the upper, lower and rear edges $\mathbf{11}_U$, $\mathbf{11}_L$ and $\mathbf{11}_R$ of the partition 11.

All the gaskets can be in the form of strips of a flexible material durable to the heat produced by the heating devices 10. To facilitate their staying in place during the assembly and use of the system 1, the gaskets can have an adhesive coating along at least a part of their surfaces.

In the example of FIG. 2B, the heating system 1 can be assembled from the two units $\mathbf{100}_R$ and $\mathbf{100}_L$ and the connection and sealing elements described above, by the following steps:

(a) placing the units $\mathbf{100}_R$ and $\mathbf{100}_L$ adjacent to each other so that their attachment flanges $\mathbf{3}_R$ and $\mathbf{3}_L$ face each other, and there are formed the top, bottom and rear attachment areas 62, 63 and 65, respectively, and the common recess 67;

(b) mounting the outer gaskets to the outer portions of the top attachment area 62, bottom attachment area 63 and rear attachment area 65;

(c) connecting the connecting elements along the respective attachment areas 62, 63 and 65 by:

i) connecting the rear plate 25 to the recess 67;

ii) connecting the top and bottom connecting members at the right and left sides in their respective attachment areas;

iii) connecting the top connecting members to each other;

iv) connecting the bottom connecting members to each other;

(d) gluing the inner gaskets along the attachment edges of the top, bottom and rear attachment areas 62, 63, 65;

(e) mounting the partition 11 so as to sealingly connect its upper edge $\mathbf{11}_U$ to the top attachment area 62, its lower edge $\mathbf{11}_L$ to the bottom 63 attachment area, and its rear edge $\mathbf{11}_R$ edge to the rear attachment area 65 with the inner gaskets mounted therebetween; and (f) mounting the front walls $14_R$ and $14_L$ to the front flanges $2_R$ and $2_L$, of the units 100 respectively, and gluing their attachment edges, so as to close the interiors 18 of the units at their fronts and so as to provide contact between the seam area and said front edge of the partition $11_F$, converting thereby each unit into an individually operative heating device 10 within the system 1.

Figures 3A, 3B:
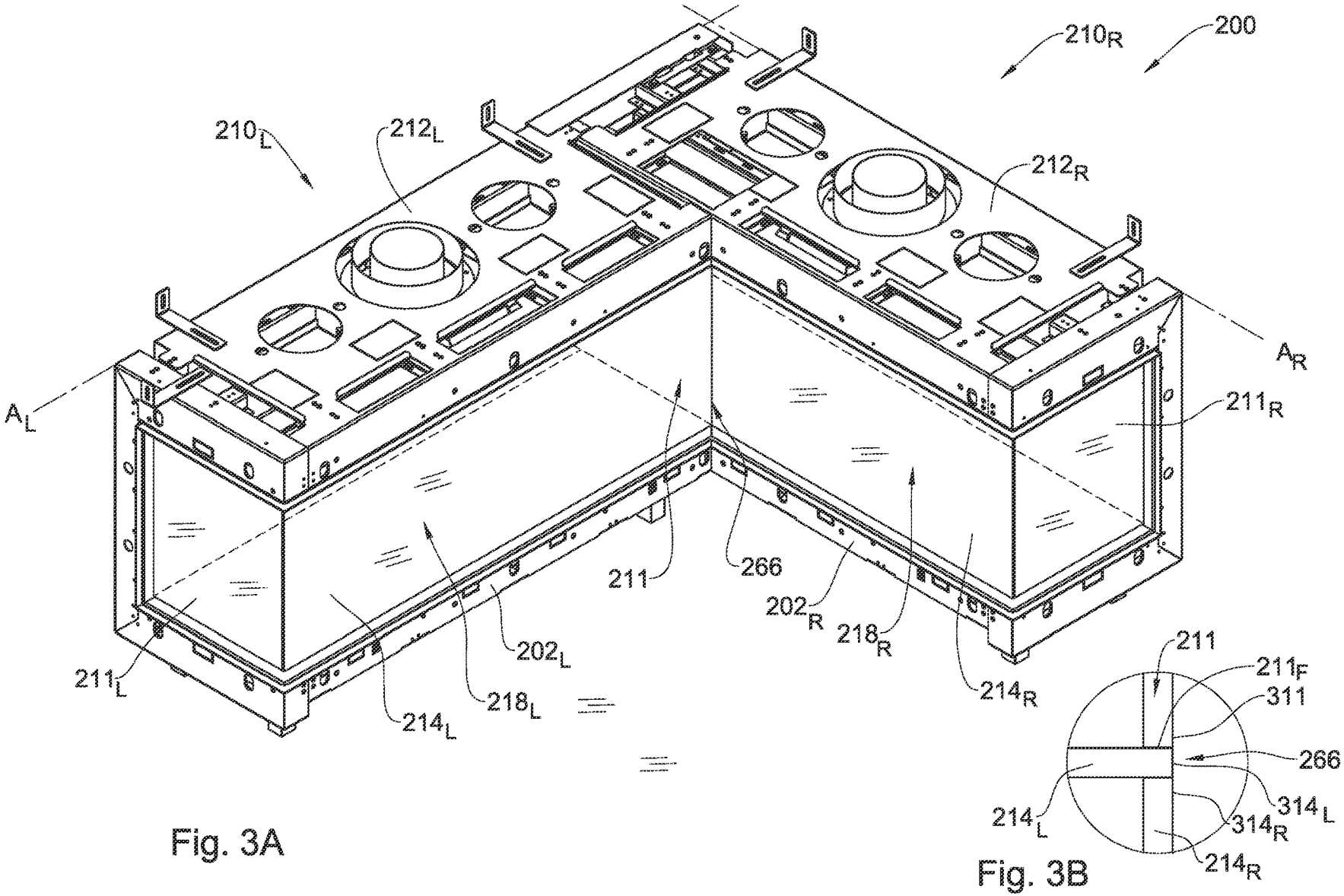
FIG. 3A is a perspective view of an example of a corner heating system, according to another embodiment of the presently disclosed subject matter.
FIG. 3B is a schematic enlarged illustration of a seam area of the system shown in FIG. 3A, in its top view.
Figure 4:
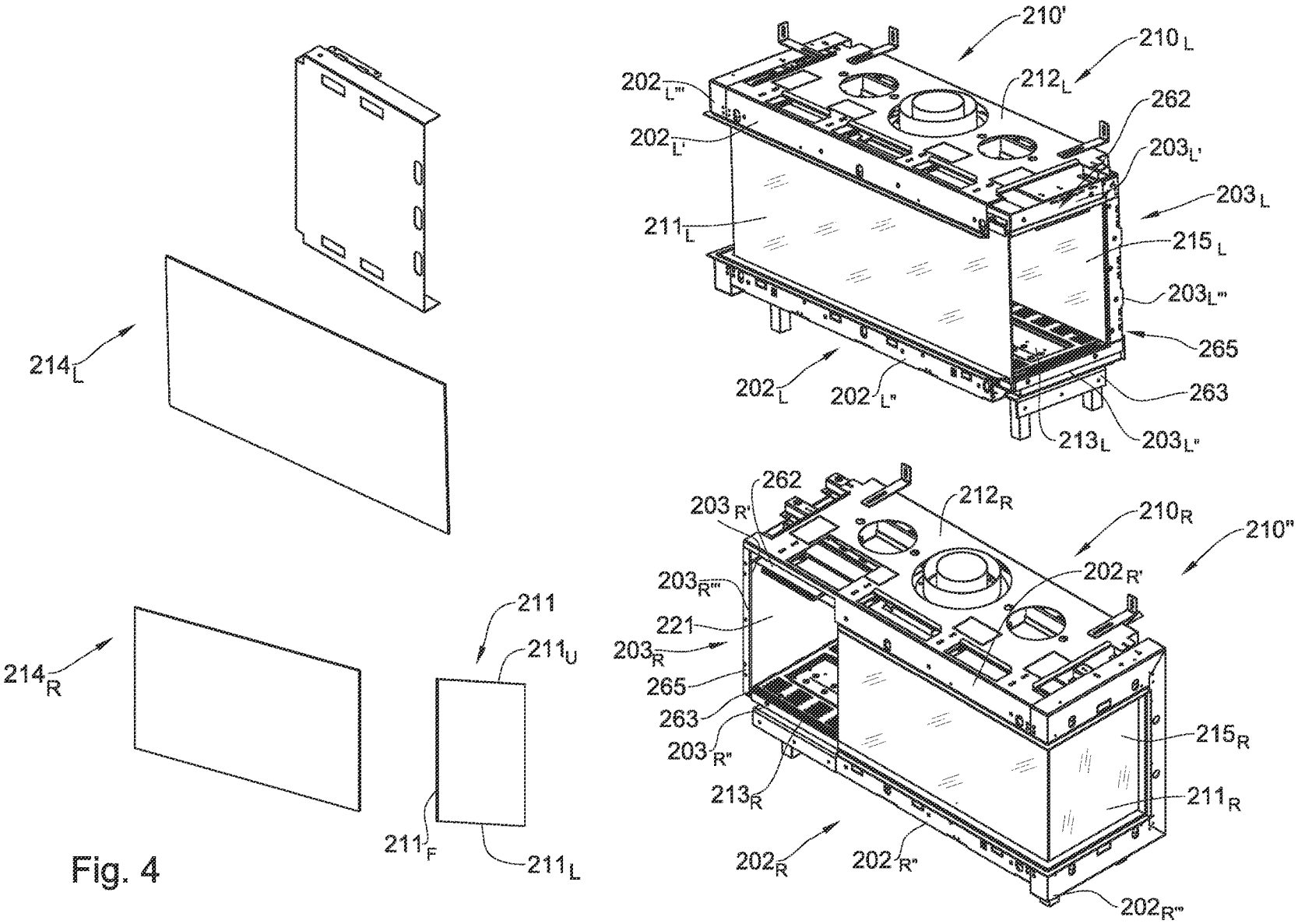
FIG. 4 is an exploded view of a heating system shown in FIG. 3A, without its connection and sealing elements.

FIGS. 3A and 4 demonstrate one example of a corner heating system generally designated as 200, according to another embodiment of the presently disclosed subject matter.

The heating system 200 comprises two heating devices 210 having the same structure of the heating devices 10, but having their longitudinal axes perpendicular to each other. In the described example, the number of the heating devices is two, and they will further be referred to either as 'the heating devices 210' or as 'a right heating device $210_R$' and 'a left device $210_L$', however a system according to the presently disclosed subject matter can have three or more such devices, at least two of which can be as described herein with reference to the heating devices 210.

Similarly to the heating devices 10, the heating devices $210_R$ and $210_L$ have respective front flanges $202_R$ and $202_L$ and attachment flanges 203R and 203L, at which the heating devices are fixedly and sealingly attached to each other, so that their front flanges are perpendicular to each other to constitute a single front flange 202 of the system 200.

The front flange $202_R$, $202_L$ of each of the heating devices is defined by a front flange top edge $202_R'$, $202_L'$, a front flange bottom edge $202_R''$, $202_L''$, and a front flange side edge $202_R'''$, $202_L'''$ extending therebetween and spaced from the attachment flange $203_R$, $203_L$ of the heating device.

The attachment flange $203_R$, $203_L$ of each of the heating devices 210 is defined by respective attachment flange top edge $203_R'$, $203_L'$, an attachment flange bottom edge $203_R''$, $203_L''$, and an attachment flange rear edge $203_R'''$, $203_L'''$ extending therebetween.

More particularly, similarly to both heating devices 10, the left heating device $210_L$ comprises:

a top wall $212_L$ whose front edge constitutes the front flange top edge $202_L'$ and whose side edge disposed adjacent right heating device constitutes the attachment flange top edge $203_L'$, a bottom wall $213_L$ whose front edge constitutes the front flange bottom edge $202_L''$ and whose side edge disposed adjacent the right heating device constitutes the attachment flange bottom edge $203_L''$, and a rear wall $215_L$ whose side edge disposed adjacent the right heating device constitutes the attachment flange rear edge $203_L'''$, and a side wall $211_L$, whose front edge spaced from the attachment flange $203_R$ constitutes the front flange side edge $202_L'''$.

The right heating device $210_R$, however, is different from the left heating device $210_L$ as follows:

though it has a top wall $212_R$ similar to that of the left heating device, a part of its front edge constitutes the front flange top edge $202_R'$ and the remainder of its front edge constitutes the attachment flange top edge $203_R'$;

though it has a bottom wall $213_R$ similar to that of the left heating device, a part of its front edge constitutes the front flange bottom edge $202_R''$ and the remainder of its front edge constitutes the attachment flange bottom edge $203_R''$; and it has two side walls $211_R$ and 221, between which a rear wall $215_R$ extends and of which the side wall 221 that is disposed adjacent the rear wall of the left heating device has a front edge constituting the attachment flange rear edge $203_R''$.

The system 200 has top, bottom and rear connection and sealing elements (not seen) used to provide a fixed connection between the respective top and bottom walls of the heating devices 210, as well as connection between the side wall 221 of the right heating device and the rear wall $215_L$ of the left heating, at their respective attachment flanges, and forming top, bottom and rear attachment areas therebetween generally designated as 262, 263, 265 and similar to the respective attachment areas 62, 63 and 65 of the system 1.

The system 200 further comprises a transparent partition 211 having a partition upper edge $211_U$ sealingly connected to the top attachment area 262, a partition lower edge $211_L$ sealingly connected to the bottom attachment area 263 and a partition rear edge $211_R$ sealingly connected to the rear attachment area 265; the transparent partition 211 further include a front edge 211F.

The system 200 further comprises transparent front walls $214_R$ and $214_L$ connected to the front flanges $202_R$ and $202_L$ of the heating devices and oriented perpendicularly to each other, the front walls being connected to each other so as to form a common front wall 214 of the system. FIG. 3B shows an area 266, at which the front walls and the partition 211 meet each other, by means of their contacting surfaces $314_R$, $314_L$ and 311, respectively.

Reverting to FIG. 3A, the heating devices each has its own interior $218_R$, $218_L$ bounded by the front, top, bottom, rear and side walls of the respective device $210_R$, $210_L$ as well as the partition 211.

The front wall 214 can be produced as a single unitary body, and in any case this wall or the front walls $214_R$ and $214_L$ constituting it as described above, as well as the partition 211, can be made of glass or transparent thermo-resistant plastic, so that the partition can be invisible from an exterior of the system though the front wall, and the two interiors $218_R$ and $218_L$ can be seen as a single continuous interior 218 of the system. The glue, by which the two front walls $214_R$ and $214_L$ and, optionally, the partition 211, can be connected to each other at the area 266 can be any transparent glue such as a silicone glue.

The front wall 214, i.e. its portions $214_R$ and $214_L$, and the partition 211 can be made of glass or transparent thermo-resistant plastic, so that the two interiors $218_R$ and $218_L$ can be seen from an exterior of the system as a single L-shaped interior 218 of the system. The glue, by which the two front walls $214_R$ and $214_L$ and the partition 211 can be connected to each other along their associated edges can be any transparent glue such as a silicone glue.

Further features of the heating devices 210 such as those connected with their capability of functioning as individually operable and controllable heating devices, can be fully identical to those described above with respect to the heating devices 10.

The connecting and sealing components of the system 200 and the method of assembling the system 200 using them can also be similar to those described above with respect to the system 10. Moreover, the heating devices 210 can be assembled from units designated as 210' and 210" in FIG. 4, with the difference being that the unit 210" corresponding to the right heating device can have its side wall 221 preassembled thereto or alternatively, this side wall can be configured for being mounted to the unit 210" when the system 200 is assembled. This side wall 221 can thus be made of the same material as the rear, top and bottom walls of the heating devices, such as a sheet metal e.g. aluminum.

In all the above embodiments, side walls of the heating devices not participating in the attachment thereof to each other can be made of the same material as the front wall, if it is desired for them to be transparent, or made of the same material as the other non-transparent walls of the heating devices.

A skilled person in the art will understand that above description is mostly directed to features of the heating devices that are relevant to their use as modules for producing modular systems similar to the systems 10 and 200, and that the heating devices can have any other features known in the art whose description herein was not deemed to be relevant.

The invention claimed is:

1. A heating system, which when assembled, comprises:

at least two heating devices, each having side, front and rear walls extending between upper and lower walls of the device all defining therebetween an interior of the heating device, and each comprising an air inlet configured to allow air flow into said interior and an exhaust outlet in gas communication with said interior to carry exhaust away therefrom during operation of the device;

a partition constituting at least a part of one wall of each of the devices, which separates between the interiors thereof, the partition having upper, lower, rear and front edges, which are disposed adjacent the respective upper, lower, rear and front walls of the two devices;

a sealing arrangement mounted at least along the upper, lower and rear edges of the partition to at least reduce a heat transfer between the interiors of the two devices at said edges so as to allow individual heating operation of each of the heating devices; and a common front wall constituted by the front walls of the two devices, the common front wall being at least seen from an exterior of the system as a single front face of the system;

wherein each of the at least two heating devices has a longitudinal axis extending within the interior of the heating device along the front, rear, upper and lower walls thereof so as to cross the side walls of the heating device wherein the at least two heating devices are so attached to each other that the longitudinal axes thereof form an angle with each other, the partition being oriented so as to form corresponding angles with the longitudinal axes of the at least two heating devices, and constituting a side wall of a first one of the at least two heating devices and an extension of the front wall of a second one of the at least two heating devices.

2. The heating system according to claim 1, further comprising connection elements, by virtue of which said two heating devices are fixedly attached to each at their upper, lower and rear walls.

3. The system according to claim 1, wherein the heating devices are so attached to each other that their longitudinal axes are aligned, the partition being oriented perpendicularly to these axes and constituting a common side wall of the devices.

4. The system according to claim 1, wherein the partition is perpendicular to the longitudinal axis of the first device and parallel to the longitudinal axis of the second device.

5. A kit for assembling a heating system, which when assembled comprises: at least two heating devices, each having side, front and rear walls extending between upper and lower walls of the device all defining therebetween an interior of the heating device, and each comprising an air inlet configured to allow air flow into said interior and an exhaust outlet in gas communication with said interior to carry exhaust away therefrom during operation of the device; a partition constituting at least a part of one wall of each of the devices, which separates between the interiors thereof, the partition having upper, lower, rear and front edges, which are disposed adjacent the respective upper, lower, rear and front walls of the two devices; a sealing arrangement mounted at least along the upper, lower and rear edges of the partition to at least reduce a heat transfer between the interiors of the two devices at said edges so as to allow individual heating operation of each of the heating devices; and a common front wall constituted by the front walls of the two devices, the common front wall being at least seen from an exterior of the system as a single front face of the system, the kit comprising:

at least two units each configured to be assembled in the system so as to independently function as one of the heating devices having its own interior, each unit having an air inlet configured to allow air flow into the interior and an exhaust outlet in gas communication with said interior to carry exhaust away therefrom, in operation of the device, the units each being free of a front wall and a wall which can be used for separating between the interiors of the devices, these walls being other than upper, lower and rear walls of the units;

complementary walls configured to be mounted to the units during assembly of the system to convert them into the heating devices each having its own interior, the complementary walls including:

at least one wall configured to provide each of the two devices with its front wall and to constitute a common front wall of the system seen from an exterior of the system as a single front face thereof; and a partition configured to be mounted between the units so as to separate between the interiors of the two devices; the partition having an upper, lower, rear and front edge and having such shape and dimension as to allow these edges to be disposed adjacent the respective upper, lower, rear and front walls of the two units;

connecting elements configured to fixedly attach said units to each other at their upper, lower and rear walls; and a sealing arrangement configured to be mounted along the upper, lower and rear edges of the partition to at least reduce heat transfer between the interiors of the two devices at said edges, when the two units are fixedly attached to each other, so as to allow each of the devices to operate individually within said system.

6. The kit according to claim 5, wherein each unit has a longitudinal axis extending along the rear, upper and lower walls thereof.

7. The kit according to claim 6, wherein the units are configured to be so attached to each other that their longitudinal axes are aligned, the partition being configured for mounting between the two units perpendicularly to these axes and so as to constitute a common side wall of the devices.

8. The kit according to claim 6, wherein the units are configured to be so attached to each other that their longitudinal axes form an angle with each other, the partition being configured for mounting in such orientation as to form corresponding angles with the longitudinal axes of the devices, and as so as to constitute a side wall of a first one of the two devices and an extension of the front wall of a second one of the devices.

9. The kit according to claim 8, wherein the partition is configured for mounting so as to be perpendicular to the longitudinal axis of the first unit and be parallel to the longitudinal axis of the second unit.

* * * * *